US009056338B2

(12) United States Patent
Bowman

(10) Patent No.: US 9,056,338 B2
(45) Date of Patent: Jun. 16, 2015

(54) SELF CLEANING PIEZOELECTRIC CHEMICAL APPARATUS AND METHOD OF USE

(71) Applicant: John Bowman, Rehoboth Beach, DE (US)

(72) Inventor: John Bowman, Rehoboth Beach, DE (US)

(73) Assignee: Scientific Industrial nano Engineering, LLC, Williamston, MI (US)

( * ) Notice: Subject to any disclaimer, the term of this patent is extended or adjusted under 35 U.S.C. 154(b) by 0 days.

(21) Appl. No.: 13/946,992

(22) Filed: Jul. 19, 2013

(65) Prior Publication Data

US 2014/0020707 A1 Jan. 23, 2014

Related U.S. Application Data

(60) Provisional application No. 61/673,865, filed on Jul. 20, 2012.

(51) Int. Cl.

| | |
|---|---|
| ***B08B 9/032*** | (2006.01) |
| ***B08B 7/02*** | (2006.01) |
| ***B08B 17/02*** | (2006.01) |
| ***F04B 17/00*** | (2006.01) |
| ***F04B 43/04*** | (2006.01) |
| *B08B 3/12* | (2006.01) |

(52) U.S. Cl.

CPC ..... *B08B 9/0326* (2013.01); *B08B 9/0325* (2013.01); *B08B 3/12* (2013.01); *B08B 7/026* (2013.01); *B08B 7/02* (2013.01); *B08B 17/02* (2013.01); *F04B 17/003* (2013.01); *F04B 43/046* (2013.01)

(58) Field of Classification Search

None

See application file for complete search history.

(56) References Cited

U.S. PATENT DOCUMENTS

| | | | | |
|---|---|---|---|---|
| 5,395,592 | A * | 3/1995 | Bolleman et al. | 422/128 |
| 6,375,753 | B1 | 4/2002 | Tolia et al. | |
| 6,418,960 | B1 | 7/2002 | Mintz et al. | |
| 6,973,972 | B2 | 12/2005 | Aronstan | |
| 7,028,701 | B1 | 4/2006 | Law et al. | |
| 7,598,654 | B2 | 10/2009 | Goodson | |
| 2011/0068654 | A1 | 3/2011 | Cheng et al. | |

FOREIGN PATENT DOCUMENTS

| | | |
|---|---|---|
| FR | 2572141 A1 | 4/1986 |
| WO | PCT/US/51409 | 1/2014 |

OTHER PUBLICATIONS

U.S. Appl. No. 61/673,865, Bowman, John.

International Patent Search for PCT US13946992, Date of completion: Feb. 12, 2013.

* cited by examiner

*Primary Examiner* — Eric Golightly

*Assistant Examiner* — Arlyn I Rivera-Cordero

(74) *Attorney, Agent, or Firm* — Harris, Shelton, Hanover & Walsh; Susan B. Fentress

(57) ABSTRACT

The invention is a piezoelectric self-cleaning apparatus, such as a chemical injection pump. The chemical injection pump is self-cleaning by employing either as an integral part or as an added part, a piezoelectric component that implosively cleans the pump head. This invention involves a liquid delivery system made of a liquid processing path and a piezoelectric actuator connected to or integral with said liquid processing path to enhance removal of unwanted solids from the liquid processing path or to maintain a blend, mix and/or integrity of a liquid chemical, wherein the liquid chemical does not precipitate particles, crystallize, separate or come out of solution.

19 Claims, 4 Drawing Sheets

SELF CLEANING PIEZOELECTRIC CHEMICAL APPARATUS AND METHOD OF USE

RELATED PATENT APPLICATIONS

This patent application Claims the benefit of U.S. provisional patent application No. 61/673,865 under 35 U.S. §119 (e) (hereby specifically incorporated by reference).

FIELD OF THE INVENTION

This invention relates to a piezoelectric self-cleaning apparatus designed to keep liquid processing path clear.

BACKGROUND OF THE INVENTION

Mechanical pumps move chemicals through liquid processing path. These pumps can be adversely affected by clogging if the media(s) harden when the pump is off for too long a period or if particulates fall out of suspension due to various factors (such as pressure and temperature changes). Additionally, the pump can be damaged by media blends separating while in the feed system, causing failure of the engineered chemical effects (such as in water or waste purification, oil/gas drilling, drug dispensing and food additives).

SUMMARY OF THE INVENTION

The present invention relates to a piezoelectric self-cleaning apparatus, such as a chemical injection pump. The chemical injection pump is self-cleaning by employing, either as an integral part or as an added part, a piezoelectric actuator that implosively cleans the pump. This is accomplished by exciting the piezoelectric actuator (in a range from Hz to MHz) at various frequencies specific to the chemical or blend of chemical in the apparatus.

More specifically, this invention relates to a liquid delivery system providing a liquid processing path and a piezoelectric actuator connected to or integral with the liquid processing path to enhance removal of unwanted solids from the liquid processing path or to maintain a blend, mix and/or integrity of the chemical so that it does not precipitate particles, crystallize, separate or come out of solution. In this invention, the piezoelectric actuator can be a transducer for cleaning the liquid path or a piezo-material vibrating disc operating at selected frequencies to maintain a blend, mix and/or integrity of the chemical, so that it does not precipitate particles, crystallize, separate or come out of solution.

Additionally this invention provides a method to remove unwanted solids from a liquid processing path to prevent the unwanted solids from clogging a liquid processing path in the pump head. This invention involves providing a piezo-material transducer within the inlet for a pump head, and also providing a modulated DC voltage at a desired frequency and voltage level to the piezo-material transducer to generate acoustic waves in the liquid to remove unwanted solids from a liquid processing path, wherein the liquid is a chemical. The piezo-material transducer can be provided as an integral part of the inlet or connected to the inlet of a pump head.

This invention further provides a method to maintain a blend, mix and/or integrity of the chemical, so that it does not precipitate particles, crystallize, separate or come out of solution, by providing an at least one piezo-material vibrating disc located in the outlet of the pump head and providing a modulated DC voltage at a desired frequency and voltage level to the piezo-material vibrating disc to generate acoustic waves to maintain a blend, mix and integrity of a chemical in solution, wherein the chemical does not precipitate particles, crystallize, separate or come out of solution. In the preferred embodiment the at least one piezo-material disc is a plurality of piezo-material discs.

This invention further provides a computer controlled apparatus to prevent unwanted solids from clogging a liquid processing path or to maintain a blend, mix and/or integrity of a liquid chemical, wherein the liquid chemical does not precipitate particles, crystallize, separate or come out of solution. This apparatus includes a piezoelectric actuator connected to or integral with the liquid processing path, a central processing unit programmed to control the delivery of DC voltage to the piezoelectric actuator at a desired frequency and voltage level to generate acoustic waves in the liquid, to remove unwanted solids from a liquid processing path or to maintain a blend, mix and/or integrity of the chemical so that it does not precipitate particles, crystallize, separate or come out of solution, wherein the liquid is a chemical; and means to transmit the modulated voltage to the piezoelectric actuator.

BRIEF DESCRIPTION OF THE SEVERAL VIEWS OF THE DRAWING

For a fuller understanding of the nature and desired objects of the present invention, reference is made to the following detailed description taken in conjunction with the accompanying drawing figures.

DETAILED DESCRIPTION OF THE INVENTION

Figure 1:
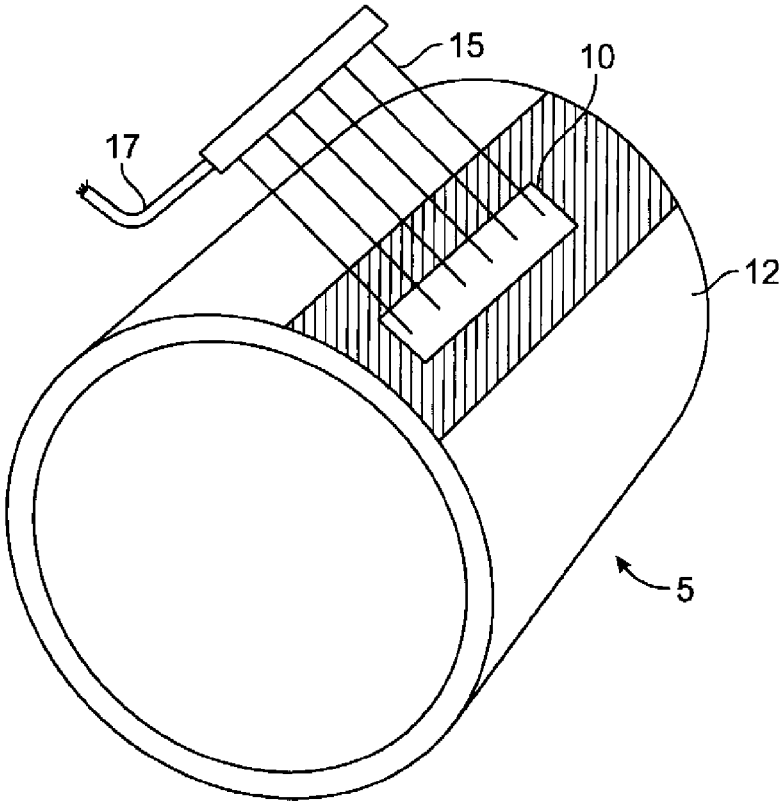
FIG. 1 shows a perspective view of a vibrating actuator of a piezo-material transducer.

The present invention may be understood more readily by reference to the following detailed description of the invention. It is to be understood that this invention is not limited to the specific devices, methods, conditions or parameters described herein, and that the terminology used herein is for the purpose of describing particular embodiments by way of example only and is not intended to be limiting of the Claimed invention. Also, as used in the specification including the appended Claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment.

The present invention relates to a piezoelectric self-cleaning apparatus, such as a chemical injection pump. The chemical injection pump is self-cleaning by employing either as an integral part or as an added part, a piezoelectric component that implosively cleans the pump head. Various advanced materials can be used for this purpose including, for example, lead zirconate titanate (PZT), polyvinylidene difluoride (PVDF), and Lithium Niobate. These piezoelectric materials can be used to make pump parts and assemblies that form part of the pump head and can either be driven between hertz to megahertz range or be electronically resonated in the kilohertz frequency range. These parts can be either automatically or periodically actuated for implosive cleaning of unwanted materials that form as a residue in the pump. Additionally the piezoelectric parts can be electronically driven at various frequencies specific to the chemical or blend of chemicals in the apparatus, such as a pump, to maintain particles or a specific chemical blend from precipitating or separating out of an emulsion while in the apparatus.

A piezoelectric transducer is a transducer composed of a piezoelectric material, such as a crystal, that converts an electrical signal to a mechanical or acoustic signal and vice versa. In this invention, a piezo-material component integral with an inlet for a pump head functions as a transducer. The piezo-material is actuated by providing a modulated DC voltage at the desired frequency and voltage level, which is sufficient to generate acoustic waves in the liquid to remove unwanted solids from a liquid processing path. The desired frequency and voltage values are selected based on the specific application, such as cleaning or chemical mixing. Power supplies for the piezo-materials can range from power densities up to 10 w/sq·cm and frequencies up to 10 MHz depending on the applications of interest. Power supplies are standard commercial systems that would be known to those that understand the art.

The term driving frequency means the frequency of the driving force. The driving force is an external force and in this invention this is the modulated DC voltage. The piezo-material voltage is defined as the voltage required to actuate the piezo-material. Driving frequency is the frequency of the driving force. The driving force is an external force applied to the oscillator. Voltage and frequency combination is generated using industry standard piezoelectric power supplies.

The piezoelectric self-cleaning apparatus can be used with a variety of chemical, some examples include: sodium hypochlorite, aluminum sulfate, sulphuric acid and caustic polymer phosphate. Sodium hypochlorite is used in water purification.

The frequency ranges contemplated by this invention include: sub-KHz frequency range where resonant effects from piezo material geometries can be used, 20 to 40 KHz frequency range to provide relatively fast cleaning (minutes) for large and simple geometric surfaces, 40-70 KHz frequency range for surfaces with complex geometries, 70 KHz to 10 MHz frequency range for specialty operations such as the fine, gentle cleaning of surfaces and mixing of chemicals. In one embodiment, the piezo-material transducer 5 is used for cleaning process with 40 KHz or less frequencies.

Figure 2:
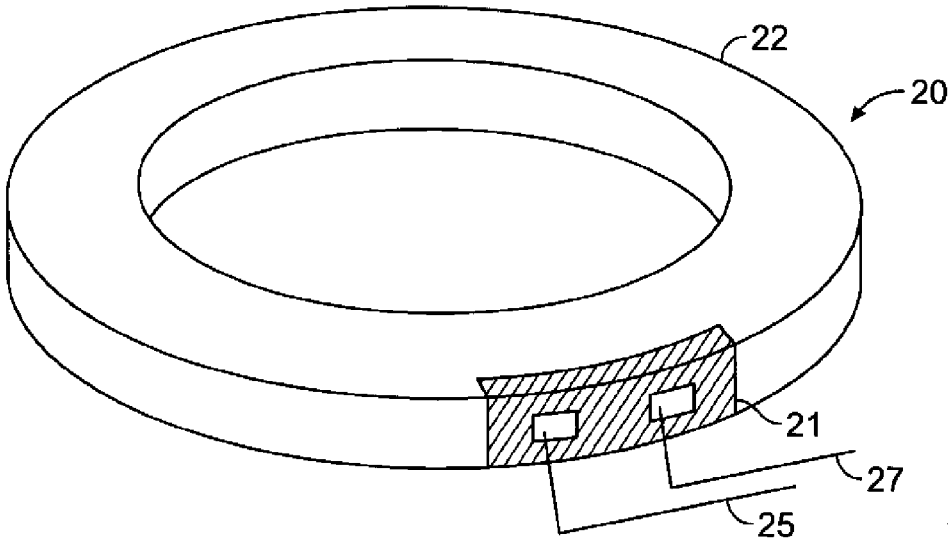
FIG. 2 shows a perspective view of a vibrating disc of a piezo-material.
Figure 3:
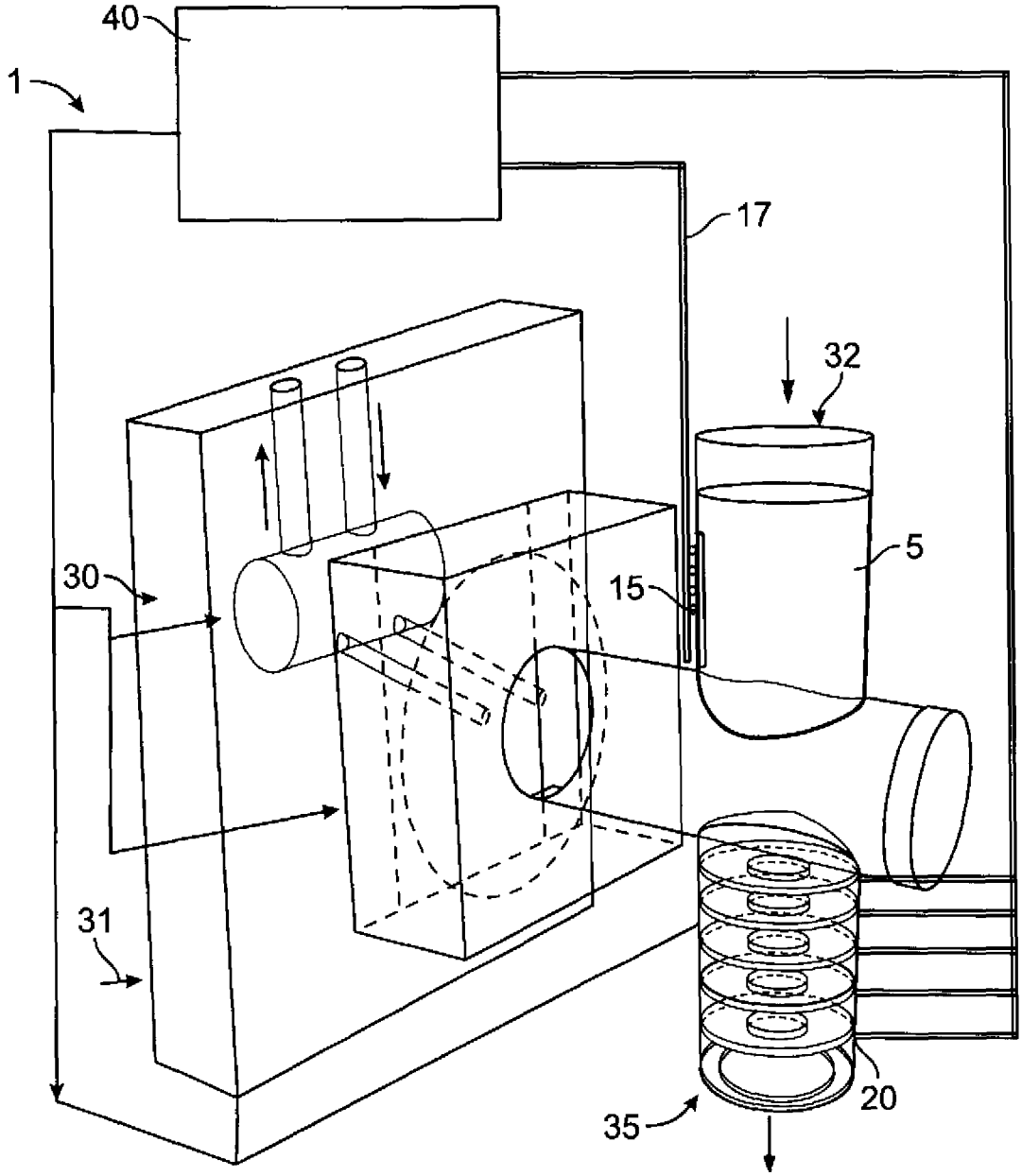
FIG. 3 shows a perspective view of self-cleaning chemical apparatus such as a metering pump.

FIGS. 1 and 2 show individual piezo-ceramic components that are part(s) of an automatic self-clean and vibrating chemical metering pump shown in FIG. 3. More specifically, FIG. 1 shows piezo-material transducer 5 made of a piezo-material in the form of a cylinder; however, any geometrical form that provides the necessary vibrations can be used in this invention. In the preferred embodiment, this piezo-material is lead zirconate titanate (a piezoelectric ceramic material); however, any piezo-material can be selected based on the frequency requirements.

In this embodiment, lead zirconate titanate is coated with a protective coating preferably, titanium oxide (or any other oxide or nitride) coating which allows the piezo-material transducer 5 to be chemically inert with respect to the chemical being pumped such as sodium hypo-chlorite in all concentrations (or other aggressive chemicals), as known to one skilled in the art. See Bharat Shushan Springer Handbook of Nanotechnology, Volume 2 (hereby specifically incorporated by reference).

In the embodiment shown in FIG. 1, a coated piezo-material, preferably lead zirconate titanate, is formed into a piezo-material transducer 5 via blending material(s), pressing, heating and poling. The piezo-material transducer 5 has a connection block 10 on the outer wall 12 of the piezo-material transducer 5 for soldering directly on to the surface of the piezo-material actuator 5 a plurality of electrical connectors 15 and electrical leads, 17 as necessary to apply DC current to the piezo-material transducer 5 to achieve the current density necessary to clean by sweeping at and individually through frequencies in the kilohertz range, such as 40 KHz, at 60 KHz and 80 KHz, +/−10% sweep at each of the main cleaning frequencies.

The piezo-material transducer 5 can be integral or an add-on to a module of a chemical pump or the chemical pump itself with its own micro-controller with an embedded software program that based upon time and control of frequencies will allow the sweep and duration of the cleaning frequency based upon the "standard" known ultrasonic KHzs used, but also have a sub-routine around each standard frequency that sweeps through +/−5% either side of the frequency.

FIG. 2 shows a piezo-material vibrating disc 20. Disc 20, in the preferred embodiment, is deployed as a plurality of discs. The piezo-material vibrating disc 20 can be tuned to the unique material and material blends characteristic frequencies. In the preferred embodiment, this piezo-material is lead zirconate titanate (a piezoelectric ceramic material); however, any piezo-material can be selected based on frequency requirements. In this embodiment, lead zirconate titanate is coated with a protective coating preferably, titanium oxide (or any other oxide or nitride) coating which allow disc 20 to be chemically inert to chemical being pumped such as sodium hypo-chlorite in all concentrations (or other aggressive chemicals).

FIG. 2 shows that a piezo-material vibrating disc 20 has a connection block 21 on the outer wall 22 of the piezo-material vibrating disc 20 for soldering directly on to the surface of the piezo-material vibrating disc 20 a plurality of electrical connectors 25 and electrical leads, 27 as necessary to apply a modulated DC voltage to the piezo-material vibrating disc 20.

In one embodiment, the piezo-material vibrating disc 20 will also have a connection block 21 made of a silver/ceramic composite pad for wire attachment 25 and 27 to drive the piezo-material vibrating disc 20 to vibrate in this embodiment at megahertz frequencies (high frequency) specific for a chemical such as the common sodium hypochlorite concentrations (5 to 12% sodium hypo solutions) provided for water purification. The intent for driving at high frequency for the specific chemical (or concentration of chemical) is to generate acoustic waves in a given chemical or concentration to as to maintain an ideal blend, mix and/or integrity of the chemical so that it does not precipitate particles, crystallize, separate or otherwise degrade the intended effect of the pumped chemical.

FIG. 3 is the embodiment of the invention showing integration of the piezo-material transducer 5 in the inlet 32 and a plurality of piezo-material vibrating discs 20 in the outlet 35 of the pump head 30 of a representative reciprocating diaphragm chemical dosing metering apparatus 1 forming a liquid processing path where the liquid flows in the inlet 32 and out the outlet 35.

In this embodiment, piezo-material vibrating disc 20 will also have a connection block 21 made of a silver/ceramic composite pad for wire attachment 25 and 27 to power the piezo-material vibrating disc 20 to resonate in that piezo-material vibrating disc 20 has a connection block 21 on the outer wall 22 of the piezo-material vibrating disc 20 for soldering directly on to the surface of the piezo-material vibrating disc 20 a plurality of electrical connectors 25 and electrical leads, 27 as necessary to apply voltage to the piezo-material vibrating disc 20, connected to a microprocessor based programmable control 40. The piezo-material actuator 5 has a connection block 10 on the outer wall 12 of the piezo-material transducer 5 for soldering directly on to the surface of the piezo-material transducer 5 a plurality of electrical connectors 15 and electrical leads 17 as necessary to apply modulated DC voltage to the piezo-material actuator 5 to achieve the current density and frequency necessary to drive the piezo-material actuator 5 to ultrasonically clean the pump head 30.

The vibrating frequencies of the plurality of piezo-material vibrating discs 20 will be at higher frequencies than the piezo-material transducer 5. These higher frequencies will maintain fluid blends at a wetted pump head 30 surface. These higher frequencies are actuated and controlled via the microprocessor 40 once an hour for a selectable and programmable duration, in this embodiment. The purpose here is to 'kiss' the wetted material walls with a much gentler high frequency to keep the all boundary layers vibrating and maintain the chemical in solution.

The piezo-material transducer 5 and the array of piezo-material vibrating discs 20 can be made integrally with the pump head 30. The main pump body 31 as shown, is representative of all chemical bodies in general (which have many different physical shapes/size). The pump head 30 is a part of the main pump body 31 but because the fluids pumped pass through the pump head, 30 the main pump body 31 encompasses it and the pump motor (or prime mover) (Not shown).

Alternatively, the piezo-material transducer 5 and piezo-material vibrating discs 20 could be a separate assembly manufactured to be an add on for all the chemical metering pumps installed in the market place or as an add on for all chemical metering pumps built without self-cleaning ultrasonics and or specific chemical or chemical concentrations resonance.

A microprocessor 40 based programmable control allows for various 'blocks' of frequencies to be powered, controlled for optimum cleaning and vibrating 'tuning' effect and also to sweep through a range of frequencies for both cleaning the pump head 30 and/or vibrating the plurality of discs 20 for many different chemical or blends of chemicals. A microprocessor 40 based programmable control provides the ability to tune to and sweep through ideal cleaning frequencies and to tune to the desired frequencies of individual chemicals or blends of chemicals. This is accomplished using the same micro-controller 40 with sub-routines controlling specific (and preset selectable or user commanded) vibrating frequencies.

Figure 4:
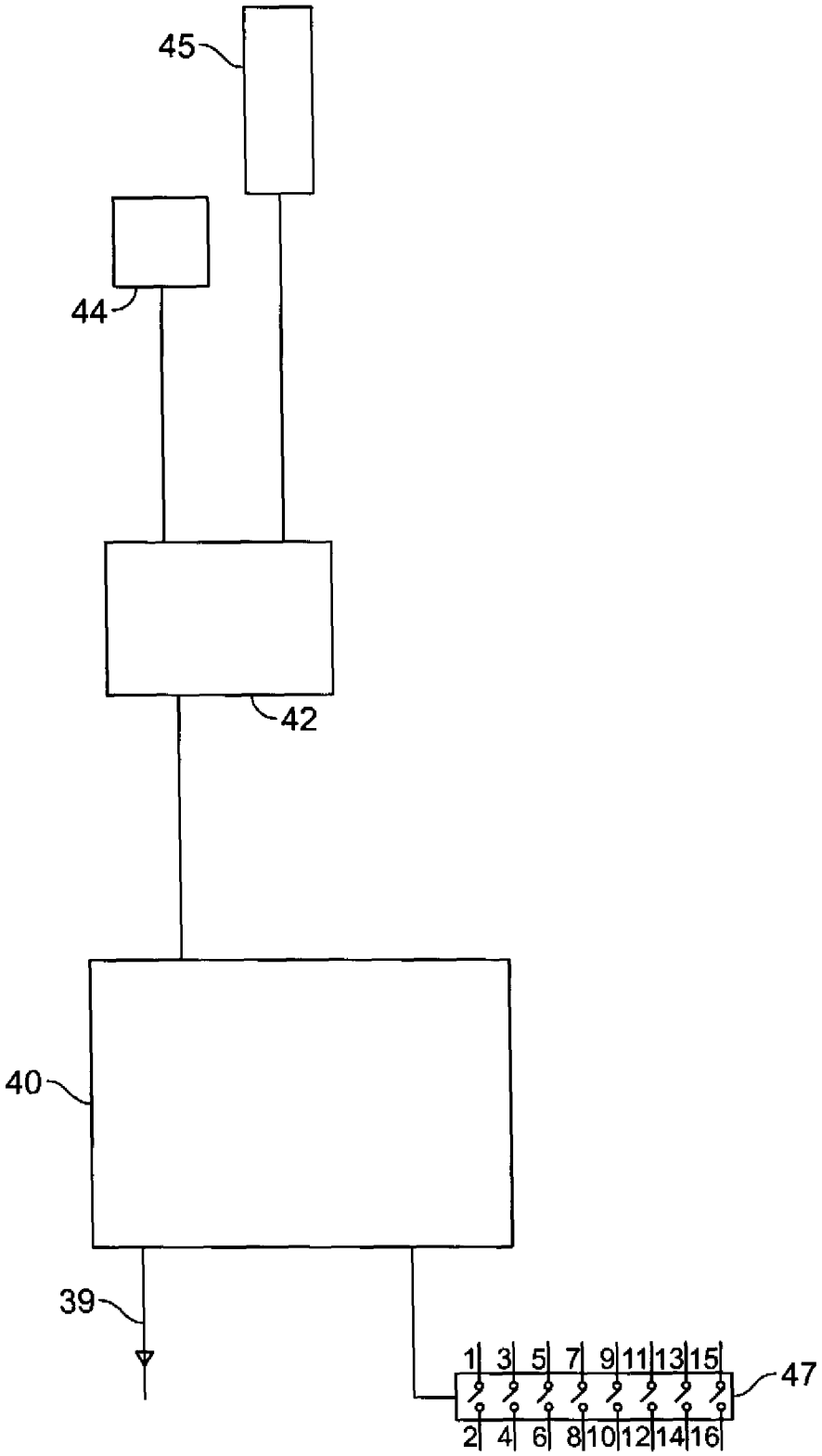
FIG. 4 shows a block diagram of this invention.
Figure 5:
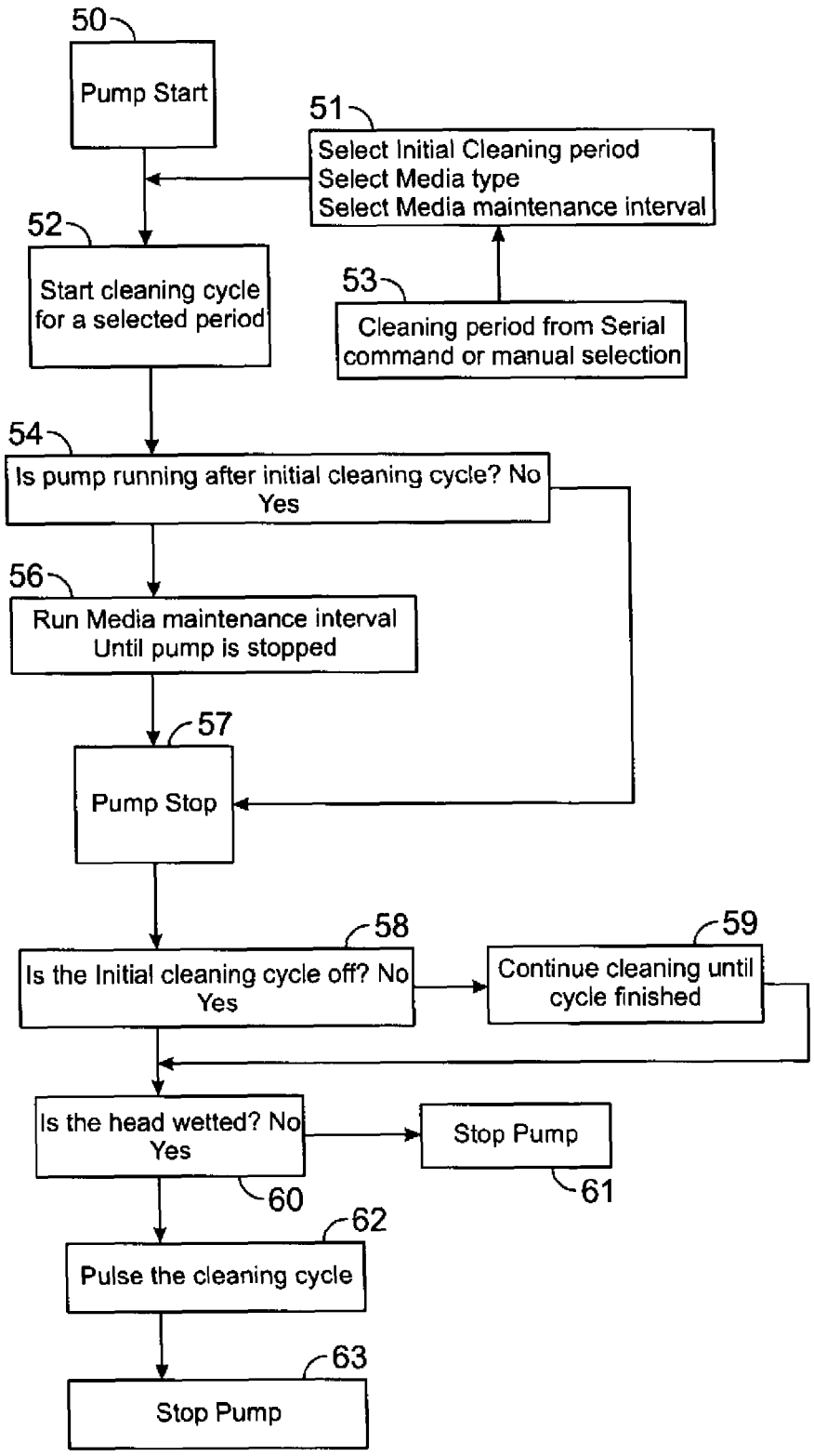
FIG. 5 shows a logic diagram of this invention.

Now referring to FIGS. 4 and 5, a block and logic diagram of the invention is shown. Serial commands input are received from a remote computer 39 to the microprocessor 40. The microprocessor 40 is connected to the power stage 42 for a plurality of piezo-material vibrating discs 20 or in the alternative an ultrasonic piezo-material actuator 5. The power stage 42 is connected to the plurality of piezo-material vibrating discs 20. The power stage 42 is connected to an ultrasonic piezo-material actuator 5. The plurality of piezo-material vibrating discs 20 are modulated by voltages nominally from 50 to 150 volts DC. The ultrasonic piezo-material actuator 5 is modulated by a FM (frequency). The modulation can be in the form of varying DC voltage or frequency modulation. This can be achieved by methods known to one skilled in the art but for illustration a switch selection frequency 47 is connected to the microprocessor 40.

Now referring to FIG. 5, in an exemplary embodiment, a cleaning period is selected from serial command or manual selection 53, then the initial cleaning period, the media type and maintenance interval is selected 51. The pump 31 is started 50. The cleaning cycle 52 is started for a selected period. If the pump 31 is not running after the initial cleaning cycle 54 then the pump 31 is stopped 57. If the pump 31 is running after the initial cleaning cycle 54 then the pump 31 is not stopped until the run media maintenance interval 56. If the pump 31 stops 57, then if the initial cleaning cycle 58 is not off continues cleaning until the cycle is finished 59. If the initial cleaning cycle 58 is off then it is determined if the head is wetted 60; if not then the pump 31 is stopped 61, if yes then the cleaning cycle is pulsed 62. After this step, the pump 31 is stopped 63.

Example 1

A ¾" chlorinated polyvinyl chloride pipe segment with scaling due to Sodium Hypochlorite, was exposed to 40 KHz frequency for 1-2 minutes using an 80 W power supply to successfully clean the pipe. A piezoelectric material (PZT) was used to generate the 40 KHz frequency in the system. Higher power can be used for larger pipe diameters and higher frequencies can be used for gentler cleaning or mixing of chemical blends within the pipe.

These and other aspects, features and advantages of the invention will be understood with reference to the detailed description herein, and will be realized by means of the various elements and combinations particularly pointed out in the appended Claims. It is to be understood that both the foregoing general description and the following detailed description of the invention are exemplary and explanatory of preferred embodiments of the invention, and are not restrictive of the invention, as Claimed.

The invention claimed is:

1. A method to maintain a blend, or mix a liquid chemical, in a liquid chemical processing path with a pump, said pump having a pump head, comprising:

providing a plurality of piezo-material discs positioned at an outlet for the pump head, and providing a modulated DC voltage at a desired frequency and voltage level to the plurality of piezo-material discs to cause said piezo-material discs to vibrate and to generate acoustic waves in said liquid chemical to maintain a blend or mix the liquid chemical in solution.

2. The method of claim 1 wherein the frequency ranges from 40 to 70 KHz.

3. The method of claim 1 wherein the frequency ranges from 70 to 100 MHz.

4. A method to remove unwanted solids from a pump in a liquid chemical processing path to prevent the unwanted solids from clogging the pump including a pump head comprising:

providing a piezo-material transducer positioned at an inlet of the pump head, and providing a modulated DC voltage at a desired frequency and voltage level to the piezo-material transducer to generate acoustic waves in the liquid chemical to remove unwanted solids from the pump, wherein said desired frequency is specific to the chemical in said path.

5. The method of claim 4 wherein the frequency ranges from 20 to 40 KHz.

6. The method of claim 4 wherein the frequency ranges from 40 to 70 KHz.

7. The method of claim 4 further comprising providing a plurality of piezo-material discs positioned at an outlet of the pump head, and providing a modulated DC voltage at a desired frequency and voltage level to the plurality of piezo-material discs to cause said piezo-material discs to vibrate and to generate acoustic waves to maintain a blend, or mix the liquid chemical.

8. The method of claim 7 wherein the frequency ranges from 70 to 100 MHz.

9. A system for maintaining a liquid chemical in solution comprising: a liquid processing path, a metering pump including a pump head, at least one piezo-material disc, wherein said at least one piezo-material disc is positioned at an outlet of said pump head and an electric power supply connected to said at least one piezo-material disc configured to provide sufficient electric power to actuate said at least one piezo-material disc to vibrate at a frequency to maintain said liquid chemical in solution.

10. The system of claim 9 wherein said at least one piezo-material disc is coated with a protective coating.

11. A system for delivery of a liquid chemical comprising: a liquid processing path, a metering pump including a pump head connected to the liquid processing path, a piezoelectric transducer positioned at an inlet of said pump head and an electric power supply connected to said piezoelectric transducer configured to provide sufficient electric power to actuate said piezoelectric transducer to vibrate at a frequency to enhance the removal of unwanted solids from the pump head.

12. The system of claim 11 wherein said liquid chemical is selected from the group consisting of: sodium hypochlorite, aluminum sulfate, sulphuric acid and caustic polymer phosphate.

13. The system of claim 11 wherein said piezoelectric transducer is coated with a protective coating.

14. The system of claim 11 further comprising at least one piezo-material disc wherein said at least one piezo-material disc is positioned at an outlet of said pump head and an electric power supply connected to said at least one piezo-material disc configured to provide sufficient electric power to actuate said at least one piezo-material disc to vibrate at a frequency to mix said liquid chemical.

15. A computer controlled apparatus to prevent unwanted solids from clogging a liquid processing path or to maintain a blend, mix and/or integrity of a liquid chemical, wherein said liquid chemical does not precipitate particles, crystallize, separate or come out of solution comprising:

a pump with a pump head having an inlet and an outlet;

a piezoelectric actuator positioned at the pump head;

a central processing unit programmed to control the delivery of DC voltage to the piezoelectric actuator at a desired frequency and voltage level to generate acoustic waves in the liquid, to remove unwanted solids from a liquid processing path, or to maintain a blend, mix and/or integrity of a liquid chemical, wherein said liquid chemical does not precipitate particles, crystallize, separate or come out of solution, wherein said liquid is a chemical; and means to transmit said modulated voltage to the piezoelectric actuator.

16. The apparatus of claim 15 wherein said piezoelectric actuator is a transducer and is coated with a protective coating.

17. The apparatus of claim 15 wherein said piezoelectric actuator is comprised of a plurality of piezo material discs.

18. The apparatus of claim 17 wherein said plurality of piezo-material discs are positioned at an outlet of the pump head.

19. The apparatus of claim 17 wherein the plurality of piezo discs are positioned at the outlet of said pump head.

* * * * *